United States Patent [19]

Shen, deceased

[11] Patent Number: 5,014,784

[45] Date of Patent: May 14, 1991

[54] STEAMFLOODING IN MULTI LAYERED RESERVOIRS

[75] Inventor: Chin-Wen Shen, deceased, late of Houston, Tex., by Tze-Chien Shen, executor

[73] Assignee: Texaco Inc., White Plains, N.Y.

[21] Appl. No.: 470,463

[22] Filed: Jan. 26, 1990

[51] Int. Cl.[5] ..... E21B 43/00

[52] U.S. Cl. ..... 166/263; 166/272; 166/302; 166/303; 166/245

[58] Field of Search ..... 166/245, 272, 302, 303, 166/203

[56] References Cited

U.S. PATENT DOCUMENTS

| | | | |
|---|---|---|---|
| 3,143,169 | 8/1964 | Foulks | 166/245 |
| 3,430,700 | 3/1969 | Satter et al. | 166/263 |
| 4,321,966 | 3/1982 | Traverse et al. | 166/245 |
| 4,491,180 | 1/1985 | Brown et al. | 166/272 |
| 4,495,994 | 1/1985 | Brown et al. | 166/261 |
| 4,660,641 | 4/1987 | Shen | 166/272 |
| 4,702,317 | 10/1987 | Shen | 166/272 |
| 4,766,958 | 8/1988 | Faecke | 166/269 |

*Primary Examiner*—Ramon S. Britts
*Assistant Examiner*—Roger J. Schoeppel
*Attorney, Agent, or Firm*—Jack H. Park; Kenneth R. Priem; Russell J. Egan

[57] ABSTRACT

A method for stimulating production of hydrocarbons from multilayered heavy oil formations starts with injecting high quality steam through a first group of wells into the lower most level. Hydrocarbon product generated by the steamflooding are extracted by a second group of wells while the steamflooding preheats the bottom of the second lowermost layer. The second group of wells are then used to inject steam into the second layer and a portion of the first group of wells are used for production from this level. The function of the groups of wells continues to alternate with each successive level while the number of wells used in each group decreases thereby increasing the areal sweep.

4 Claims, 2 Drawing Sheets

○ PRODUCTION WELL

ø INJECTION WELL

⊗ CAPPED WELL

STEAMFLOODING IN MULTI LAYERED RESERVOIRS

FIELD OF THE INVENTION

The Present Invention

The present invention relates to an improved method for utilizing steamflooding in multi-layered formations to achieve greater recovery with improved efficiency.

BACKGROUND OF THE INVENTION

It is well known that primary hydrocarbon recovery techniques recover only a portion of the petroleum in any formation. Numerous secondary and tertiary recovery techniques have been suggested and employed to increase the recovery of hydrocarbons from the formations where they are located. Thermal recovery techniques have proven to be among the most effective of these techniques in increasing the amount of oil recovered. The primary thermal recovery technique uses steam injected into the formation with the heat generated thereby warming the hydrocarbons to less viscous states wherein the steam head can drive the product through the porous formation to a recovery well. A good description of this can be found in U.S. Pat. No. 4,321,966.

Steamflooding is, however, an expensive operation requiring the use of high capital equipment that is costly to operate. Thus, it is important that the steam generating equipment be used in the most efficient manner.

It is known to steamflood a formation with high quality steam and then allow the quality of steam to taper off. This is fully described in U.S. Pat. No. 4,491,180. A somewhat similar method is described in U.S. Pat. No. 4,495,994, which also includes in situ combustion to conclude the recovery. Other known steamflooding methods include injection of polymers and other materials at some point during the operation. For example, U.S. Pat. No. 4,702,317 describes caustic agents; U.S. Pat. No. 3,853,178 describes an alkali metal hydroxide; and U.S. Pat. No. 4,660,641 describes an alkalinity agent.

All of the foregoing patents relate to recovery of hydrocarbon product from a single layer formation and do not consider problems which may arise in multi-layered formations. While it might be expected that techniques applied to a single layer formation could simply be repeated for each successive formation, this may work, but, also may be very inefficient and therefore be costly.

SUMMARY OF THE INVENTION

The present invention teaches a system of treating multi-layered hydrocarbon containing formations penetrated by a patterned array of wells by injecting a steamflood into the lower most layer, through a first set of wells, and producing the generated hydrocarbons from a second set of said wells, allowing the heat generated by this operation to heat the bottom portion of the next upwardly adjacent layer before commencing steamflooding of that layer now using at least a portion of the second set of wells as injection wells and at least a portion of the first set of wells as production wells for this second layer. This alternation of well function continues as recovery is made from successive levels of the formation.

BRIEF DESCRIPTION OF THE DRAWING

The present invention will now be described by way of example with reference to the accompanying drawings in which.

DETAILED DESCRIPTION OF THE PREFERRED EMBODIMENT

In a multi-layer heavy oil reservoir, steamflooding is generally started from the lowest layer of the reservoir. The heat brought into the lower layer can propagate to the next adjacent upper layer by conduction. Hence, the bottom of the upper layer is gradually warmed up during steamflood in the lower layer and prior to steamflood of the upper layer. The bottom region of the upper layer can be fairly well preheated at the start-up of steamflooding of these layers.

A laboratory model was constructed to represent a three dimensional model scaled to simulate a quarter of a 2.5 acre, 88 foot thick, confined five spot well array pattern in order to study the effect of preheating the bottom region of an upper layer during oil recovery. Nine thermal couples were inserted ¾" deep into the bottom of the model to measure the changes of temperature during preheating. A heating coil was placed under the bottom of the model. Steam was injected into the heating coil to preheat the model. After the bottom of the sandpack was preheated to a specified temperature; steamflood was carried out using a 60% quality steam at a 431 B/D rate for a period of 5.5 years. The experimental results are shown in the following table:

| Experiment Number | Preheated Bottom Bottom °F. | Steamflood Rate B/D | Residual Oil Oil Saturation After 5 ½ Years Steamflood % PV |
|---|---|---|---|
| 1 | 70 (no preheating) | 431 | 36.9 |
| 2 | 140 | 431 | 27.8 |
| 3 | 180 | 431 | 26.7 |
| 4 | 220 | 431 | 24.2 |

The first experiment was run as a control without preheating the bottom of the sandpack and served as a basis for comparison of the subsequent preheating experiments.

It can be seen that the residual oil saturations were substantially decreased when the bottom of the sand pack was preheated into the range of 140° F. to 220° F.

Increasing the bottom temperature resulted in lowering the residual oil saturation. The increased recovery was a direct result of the change in the heat flow pattern in the formation. Instead of ascending to the upper region of the formation, the steam following the established hot fluid channels moves along the lower region of the formation and heats up more oil.

The following methods take full advantage of the preheated formation to achieve improved oil recovery in the upper layer.

Figure 1:
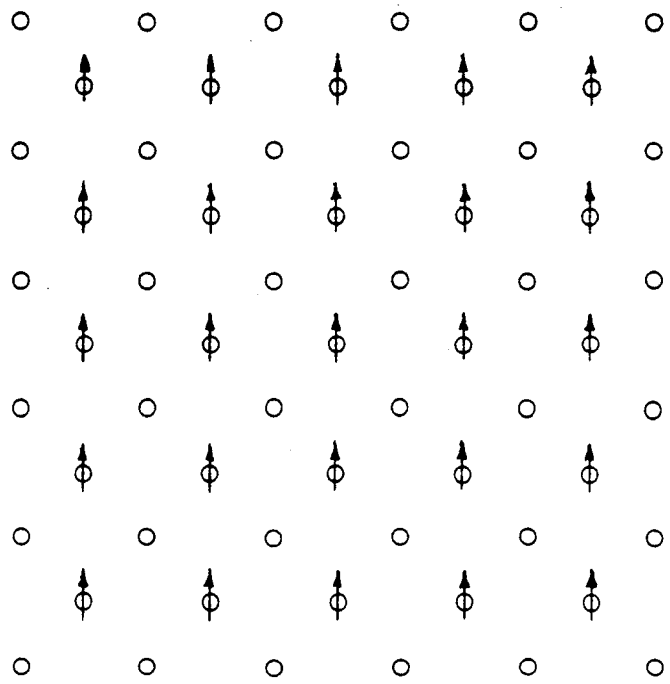
FIG. 1 is a plan view of an array of wells in a first operating condition.
Figure 2:
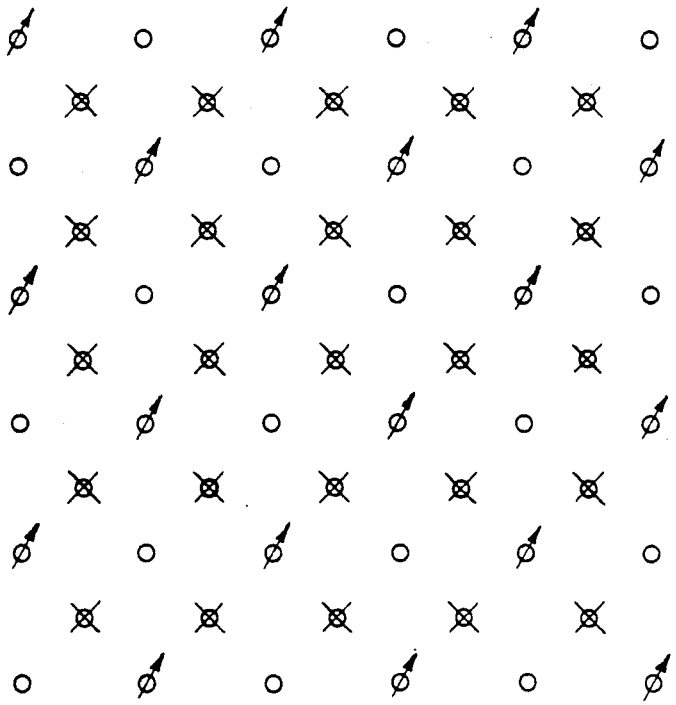
FIG. 2 is a plan view, similar to FIG. 1, showing the wells in a second operating condition.
Figure 3A:
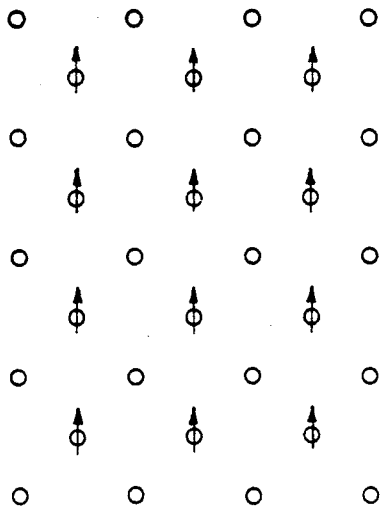
FIG. 3A and 3B are plan and diagrammatic vertical sections of wells operating in accordance with a first mode of the present invention.
Figure 3B:
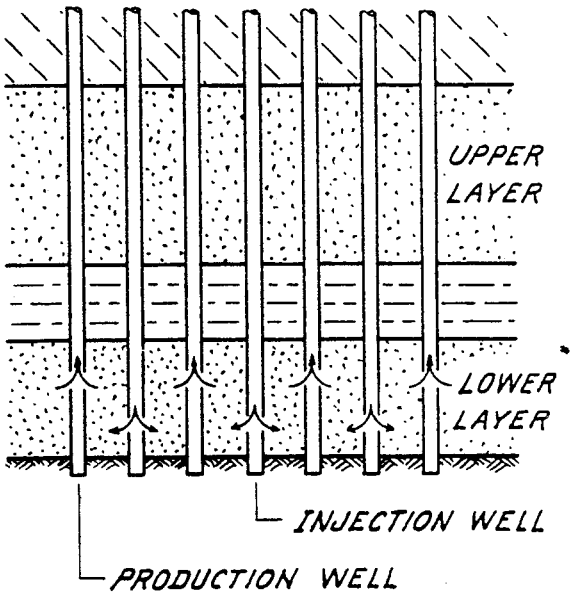

According to the first method, the bottom of the upper or second layer immediately above the steam injection well of the lower, or first layer is preheated to a higher temperature level than the bottom of the upper or second layer above the production well for the lower or first layer. Hence, steamflood carried out in the upper or second layer should be started using the production wells for the lower or first layer as the steam injection wells and for the upper or second layer using the injection wells of the lower or first layer as the production wells for the upper or second layer. This arrangement effectively utilizes the heat generated in the bottom of the upper layer to be fully used for oil recovery. This arrangement can best be seen by a comparison of FIGS. 3A and 3B with FIGS. 4D and 4B, respectively.

Figure 4A:
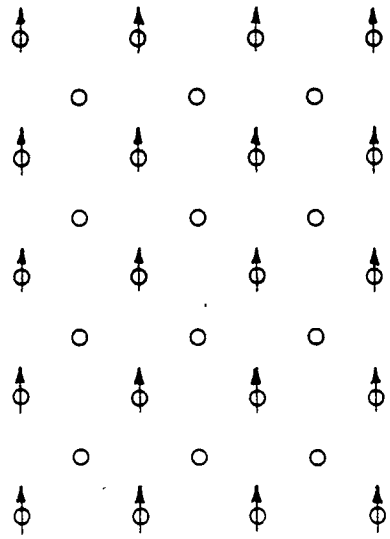
FIGS. 4A and 4B are plan and diagrammatic vertical showing the wells of FIGS. 3A and 3B operating in a second mode of the present invention.
Figure 4B:
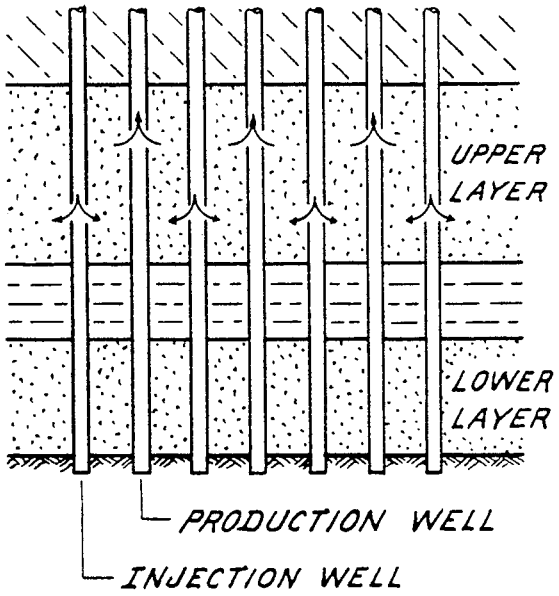

The second method recognizes that because the bottom of the upper layer has been preheated, the resistance to flow in this bottom region of the upper layer is substantially reduced. Hence, a higher steam injection rate can be used in a larger pattern and, consequently, the operating cost of steamflood can be reduced. As shown in FIGS. 4A and 4B, all the original lower level injection wells are shut in during steamflood of the upper layer. One half the number of lower level production wells are converted to new injection wells and the remaining half of the lower level production wells are used as production wells for the upper layer. This arrangement doubles the well pattern size of the upper level as compared to the well pattern size for the lower level, in this case from 2.5 to 5 acres.

What is claimed is:

1. A method for stimulating the production of hydrocarbons from multi-layered heavy oil formations penetrated by a patterned array of wells, comprising the steps of:

designating a first set of wells as injection wells and injecting about 30% to 40% pore volumes of relatively high quality steam into the lowest layer formation;

designating a second set of wells as producing wells and extracting the hydrocarbon product generated by said steamflooding of the lowest layer;

using said second set of wells as injection wells for the next upper layer in the formation, which layer has had at least the bottom most portion preheated by the steamflooding of the lower formation; and using at least some of said first set of weels as production wells for said next upper layer and extracting hydrocarbon product generated by steamflooding of said next upper layer formation.

2. A method for improving efficiency in the recovery of hydrocarbon produt from multi-layered formations containing hydrocarbons, said formations all penetrated by a patterned array of wells, comprising the steps of:

utilizing a first set of said wells as injection wells to inject steam into the lowermost of said layers;

utilizing a second set of said wells as production wells to extract from said lowermost layer the hydrocarbon product generated by said steamflooding;

utilizing at least some of said second set of wells as injection wells to inject steam into the next upper lowermost of said layers, the bottom portion of which was preheated by convection from the steamflooding of the lower layer; and utilizing at least some of said first set of wells as production wells to extract from said next upper layer the hydrocarbon product generated by said steamflooding.

3. The method according to claim 2 wherein the function of said first and said second sets of wells is exchanged for each successive layer in said multi-layered formation.

4. The method according to claim 2 wherein the wells of said array selected to form said first and said second sets of wells differ with each successive layer in said multi-layered formation.

* * * * *

UNITED STATES PATENT AND TRADEMARK OFFICE

CERTIFICATE OF CORRECTION

PATENT NO. : 5,014,784

DATED : May 14, 1991

INVENTOR(S) : Chin-Wen Shen

It is certified that error appears in the above-identified patent and that said Letters Patent is hereby corrected as shown below:

Claim 1, Col. 2, Line 10 delete "weels" and substitute therefor --wells--.

Signed and Sealed this

Fifteenth Day of September, 1992

*Attest:*

DOUGLAS B. COMER

*Attesting Officer*

*Acting Commissioner of Patents and Trademarks*